United States Patent [19]

Patel

[11] 4,262,428

[45] Apr. 21, 1981

[54] LETTERING SCALE

[76] Inventor: Narendrakumar M. Patel, 49 Moraine Rd., Morris Plains, N.J. 07950

[21] Appl. No.: 106,687

[22] Filed: Dec. 26, 1979

[51] Int. Cl.[3] ..... B43L 13/24

[52] U.S. Cl. ..... 33/477; 33/429

[58] Field of Search ..... 33/429, 476, 474, 1 B, 33/426, 477

[56] References Cited

U.S. PATENT DOCUMENTS

| | | | |
|---|---|---|---|
| 1,751,366 | 3/1930 | Shaub | 33/476 |
| 2,095,943 | 10/1937 | Zachs | 33/1 B |

FOREIGN PATENT DOCUMENTS

| | | | |
|---|---|---|---|
| 732828 | 3/1943 | Fed. Rep. of Germany | 33/476 |
| 364508 | 6/1906 | France | 33/429 |
| 913605 | 6/1946 | France | 33/476 |
| 1340185 | 9/1963 | France | 33/474 |
| 441972 | 11/1948 | Italy | 33/476 |
| 101834 | 12/1923 | Switzerland | 33/429 |
| 252151 | 10/1948 | Switzerland | 33/429 |

*Primary Examiner*—Harry N. Haroian

*Attorney, Agent, or Firm*—Anthony J. Casella; Michael A. Stallman

[57] ABSTRACT

A lettering scale for regulating the width and spacing between letters, which is used in conjunction with a straight edge guide is provided, and includes a generally planar, transparent member having first and second straight edges disposed in perpendicular relationship. A plurality of equally spaced parallel, visible guidelines are provided on the transparent member and are disposed in parallel relationship with the first straight edge. The spacing between the first straight edge and the nearest visible guideline of the array is equal to the spacing between each guideline of the array. After the drawing of horizontal guidelines, the width and spacing between letters can be regulated by the drawing of guide points, using the lettering scale. More particularly, in operation of the subject lettering guide, after a first guide point is drawn adjacent the first straight edge of the planar member, the member may be shifted in a direction perpendicular to the first straight edge by slidably moving the second straight edge along a straight edge guide until one of the visible guidelines is in register with the first guide point. Thereafter a second guide point can be drawn adjacent the first straight edge such that the second guide point is accurately spaced from the first guide point. In this manner, a plurality of guide points corresponding to the strokes of the letters may be drawn and thereafter interconnected to provide accurately sized and spaced letters.

8 Claims, 10 Drawing Figures

LETTERING SCALE

BACKGROUND OF THE INVENTION

The subject invention relates to a lettering scale for regulating the height and width of letters, as well as the spacing therebetween. More particularly, a lettering scale is provided which is used in combination with a straight edge guide, which simplifies and reduces the time necessary to draw and space letters. In use, guide points are drawn which correspond to the end points of the strokes of the letters, with the letters being completed by connecting these guide points.

The subject invention consists of a planer, transparent member having first and second straight edges which are disposed in perpendicular relationship. A plurality of spaced, parallel visible guidelines are provided on the member and are disposed in parallel relationship to the first straight edge. Each of the parallel guidelines is spaced a predetermined fixed distance from the first straight edge. In operation, after drawing horizontal guidelines, a first guide point is drawn adjacent the first straight edge. The planar member is then shifted in a direction perpendicular to the first straight edge by slidably moving the second straight edge along a straight edge guide, until one of the visible guidelines is in register with the first guide point. A second guide point may then be drawn adjacent the first straight edge. By repeating these steps, a series of accurately positioned guide points may be drawn which, when connected, produce letters having their widths regulated.

Precise, hand drawn lettering is required in many applications such as mechanical drafting, or design work Various texts are available which teach proper lettering formats, that are both technically correct and visually pleasing. One example of these texts is "Technical Drawing", by F. E. Giesseck, 6th Edition, which is incorporated herein by reference.

As described in the above noted text, proper lettering requires that each letter be of a specific height and width and that the spacing therebetween be regulated. The drawing of letters is facilitated by initially drawing horizontal and vertical guidelines. More specifically, horizontal guidelines can be used to control the height of the letters, while vertical guidelines can be used to facilitate the control of their width and spacing, as well as to keep the letters uniformly vertical. Using a simple example, when drawing standard capital letters, three horizontal guidelines are drawn including a base and top line, as well as a center line, with the spacing between each guideline being equal. The actual linear spacing between the guidelines may be varied according to the desired height of the letters, however the principles of proportions remain constant and hence, the arrangement of the guidelines will remain constant.

To aid in regulating the width and spacing of the letters, a plurality of vertical guidelines are drawn on the paper, intersecting with the horizontal guidelines. The vertical guidelines may be spaced apart a distance roughly corresponding to the spacing between the letters. The amount of spacing between the vertical guidelines is dependent upon the height of the letters, as well as the size of the particular letter which is being drawn. More specifically, and as discussed in the "Technical Drawing" text, each capital letter can be thought of as having a height of six units or the distance between the base and the top line. The width of most letters is generally five or six units. For example, the vertical strokes of the letter N are spaced five units apart. For another example, the inclined arms of the letter Y extend six units apart, while the center vertical stroke lies three units from the start of the first arm of the Y. Thus, to regulate the spacing between letters, vertical guidelines were drawn which aid in estimating the desired location of the letter. The vertical guidelines can also be used to estimate the width of the letters. The spacing between each word may also be controlled by this method. When inclined letters are desired, horizontal and inclined guidelines are generally used.

In the prior art, many instruments have been devised to aid in the drawing of these guidelines. One of the earliest of such prior art devices is exemplified in U.S. Pat. No. 1,721,793 to Rowe which provides for a lettering triangle having a plurality of holes provided therein in a spaced array. The holes in the Rowe device were provided to facilitate the drawing of parallel horizontal guidelines for regulating the height of letters. More specifically, after placing a pencil point in one of the holes provided in the Rowe device, the lettering triangle could be slid or shifted along a straight edge with the pencil point inscribing a line parallel to the straight edge. Additional parallel horizontal guidelines can be drawn by placing a pencil point in the other holes provided in the device and sliding the triangle along a fixed straight edge until an adequate number of horizontal guidelines have been provided. The vertical guidelines are drawn using one of the straight edges of the device as a guide and estimating their placement. As can be appreciated, inaccurate spacing between the vertical guidelines can easily result when the placement of the lines is estimated. Further, the drawing of both horizontal and vertical guidelines is a time consuming process.

Another example of a lettering guide in the prior art can be found in U.S. Pat. No. 2,560,736 to Olson. Similar to the device disclosed in Rowe, Olson provides for a plurality of rows of spaced apertures useful in drawing horizontal guidelines. The patent to Olson further discloses an improvement over the device shown in Rowe in that the apertures are formed in a circular member which can be rotated relative to the straight edge of the device. By this arrangement, the vertical spacing between the holes may be varied to provide horzontal guidelines to regulate the height of letters of various sizes. As with the Rowe device, to regulate the width and spacing between letters, vertical (or inclined) guidelines must be drawn, using a straight edge of the device. The spacing between these vertical guidelines is again estimated by the user, which often results in inaccurately spaced letters.

Accordingly, it is an object of the subject invention to provide a lettering scale for regulating the width and spacing between the letters, as well as aiding in maintaining uniformly vertical or inclined letters which eliminates the necessity for drawing vertical or inclined guidelines along with horizontal guidelines.

It is another object of the subject invention to provide a lettering scale which when used in combination with a straight edge guide, can facilitate the drawing of horizontal guidelines and in addition, allows the drawing of accurately spaced guide points corresponding to the end points of the strokes of a letter.

It is a further object of the subject invention to provide a preferred embodiment of a lettering scale which includes a set of apertures to facilitate the drawing of horizontal guidelines and reduces the time required to regulate the width of letters by eliminating the necessity of drawing vertical guidelines.

It is still a further object of the subject invention to provide another preferred embodiment of the lettering scale that includes spaced guide markers which further reduce the time necessary to draw letters by eliminating the necessity of drawing horizontal guidelines.

SUMMARY OF THE INVENTION

In accordance with these and many other objects of the subject invention, a lettering scale is provided to be used in combination with a straight edge guide, that includes a generally planar, transparent member having first and second straight edges disposed in perpendicular relationship. In one embodiment of the subject invention, the planar member is in the form of a draftsman triangle and is made of a clear plastic material. A plurality of equally spaced, parallel, visible guidelines are provided on the triangle and are disposed in parallel relationship with the first straight edge. The spacing between the first straight edge and the nearest visible guideline of the arry is equal to the spacing between each of the guidelines in the array.

The above described lettering scale may be used to facilitate the drawing of horizontal guidelines, or in the alternative, and as illustrated in a preferred embodiment, an array of apertures, similar to those disclosed in the prior art, may be additionally provided for that purpose.

After horizontal guidelines have been drawn on the paper for regulating the height of the letters, the width and spacing between letters may be readily regulated. In addition, the letters may be drawn uniformly without the necessity of adding vertical or inclined guidelines. More specifically, in the operation of the device, a first guide point may be drawn adjacent the first straight edge of the lettering scale which would correspond to the start of a letter. A second guide point corresponding to a fixed point in the letter may be drawn a predetermined distance away from the first guide point by shifting the member in a direction perpendicular to the first straight edge. More specifically, the member is shifted by slidably moving the second straight edge along a straight edge guide until one of the visible guidelines is in register with the first guide point. A second guide point may then be drawn adjacent the first straight edge a predetermined distance from the first guide point. For example, as noted above, the second vertical stroke of the letter N is spaced five units away from the first vertical stroke. Thus, by moving the subject lettering scale until the fifth visible guideline is in register with the first guide point, a second guide point may be drawn adjacent the first straight edge which corresponds with the second vertical stroke of the letter N. Having drawn just two guide points, the letter may be completed by drawing two vertical strokes coincident with the guide points, and adding an inclined stroke connecting the two vertical strokes. In this manner, the width of the letter has been regulated by drawing only two guide points, rather than a plurality of vertical guidelines.

The time necessary to draw accurate letters may be further reduced by eliminating the drawing of guide points which correspond to the vertical strokes of the letters. Instead, the vertical strokes can be drawn directly during the operation of the device by using the first straight edge as a guide. For example, and as described more fully hereinafter, when drawing the letter N, the first vertical stroke can be drawn directly adjacent the first straight edge. The device is then shifted in a direction perpendicular to the first straight edge until the vertical stroke, rather than merely a guide point, is in register with the fifth visible guideline. At this point, the first straight edge is spaced five units from the first vertical stroke, such that the second vertical stroke of the letter N may be drawn directly adjacent the first straight edge. The user then merely has to add an inclined stroke, connecting the two vertical strokes to complete the letter. Continued operation in this manner enables the user to draw the vertical strokes and plot out all of the necessary guide points of the letters. Thereafter, the user merely completes the letters by connecting the vertical strokes and the guide points. By this arrangement, the width and spacing between the letters my be regulated without the use of vertical guidelines.

In a preferred embodiment of the subject invention, an additional set of inclined guide lines are provided for regulating the width and spacing between inclined letters. More specifically, the planar member is formed with a triangular configuration and is provided with a central open area functioning to define a third straight edge. The third straight edge is disposed at an angle of 68.2 degrees to the second straight edge, which corresponds to the standard inclination of conventional inclined letters. The central open area of the triangle, which defines the third straight edge, provides access to the paper and thereby permits the drawing of guide points and inclined strokes adjacent the third straight edge. As with the first set of guidelines, the inclined guidelines are disposed in an equally spaced, parallel array adjacent the third straight edge. The spacing between the third straight edge and the nearest visible inclined guideline is equal to the spacing between each guideline. The use of the inclined guidelines corresponds substantially to the use of the vertical guidelines in that after a first guide point is drawn, the triangle may be slid in a direction perpendicular to the first straight edge along the straight edge guide until one of the visible inclined guidelines is in register with the first guide point. A second guide point may then be drawn adjacent the third straight edge which is accurately spaced from the first guide point. To further reduce the time necessary to draw the inclined letters, each inclined stroke may be drawn directly adjacent the third straight edge, thereby reducing the number of guide points needed to be drawn. In this manner, a set of inclined strokes and guide points may be drawn which when connected provide inclined letters having their width and spacing regulated.

Using another preferred embodiment of the subject invention, accurate letters may be drawn without the necessity of drawing vertical or horizontal guidelines. The latter embodiment of the subject invention includes a plurality of guide markers disposed adjacent the first straight edge, with the spacing therebetween corresponding to the height of the desired letters. In operation, guide points, corresponding to the strokes of the letters, are drawn adjacent not only the first straight edge but in addition, adjacent the guide markers. When vertical strokes are drawn directly on the paper, their height is regulated by limiting the length of the stroke to be within the guide markers. By this arrangement, and as more fully described hereinafter, the height and width of letters may be readily regulated.

Numerous other objects and advantages of the subject invention will become apparent from the following detailed description when taken in conjunction with the accompanying drawings in which.

DETAILED DESCRIPTION OF PREFERRED EMBODIMENTS

Figure 1:
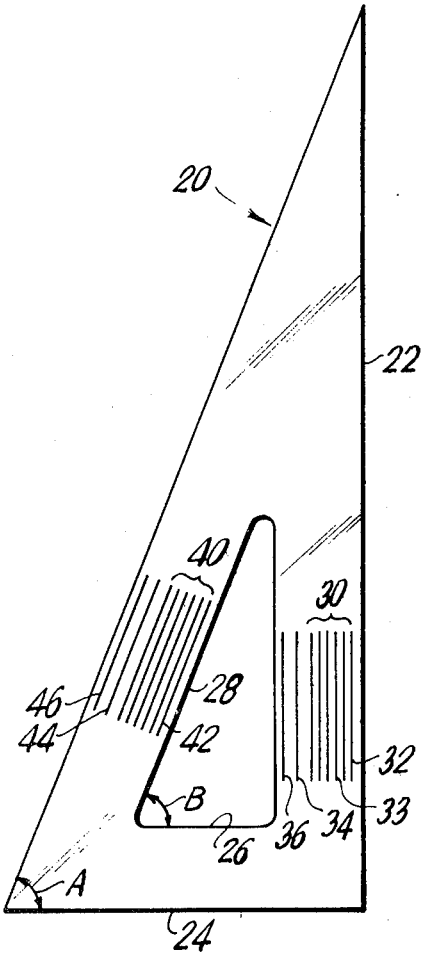
FIG. 1 is an elevational view of the lettering scale of the subject invention.

Turning now more specifically to FIG. 1, a preferred embodiment of the lettering scale 20 is illustrated and is of generally triangular configuration. The lettering scale 20 is formed of a transparent plastic material and includes a first straight edge 22 which is disposed at a right angle to second straight edge 24. The third leg of the lettering scale 20 is disposed at an angle A, which is preferably 68.2 degrees from the second straight edge 24 and corresponds to the conventional angle of inclined lettering. An open interior area 26 is provided which functions to define a third straight edge 28 which is preferably also disposed at an angle B of 68.2 degrees relative to the second straight edge 24.

In accordance with the subject invention, a plurality of spaced, parallel guidelines 30 are provided which are disposed in parallel relationship with the first straight edge 22. The guidelines are spaced a fixed distance from the first straight edge 22 such that accurately spaced guide points may be drawn. In the illustrated embodiment, six equally spaced guidelines 30 are provided with the nearest guideline 32 being spaced from the first straight edge 22 a distance equal to the spacing between each of the individual visible guidelines 30. Seventh and eighth guidelines 34 and 36 are provided to facilitate the drawing of a combination of large and small capital letters as discussed more fully hereinafter. The spacing between the sixth and seventh guidelines, as well as the spacing between the seventh and eighth guidelines 34, 36 is equal to one and one half times the size of spacing between any of the first six guidelines.

In a preferred embodiment of the subject invention, a second set of equally spaced, parallel, inclined guidelines 40 are provided which are disposed parallel to the third straight edge 28. Similar to the first set of guidelines 30, the nearest inclined guideline 42 is spaced from the third straight edge 28 a distance equal to the spacing between each of the inclined guidelines 40. In addition, while the actual spacing between the inclined guidelines 40 differ from the spacing between the vertical guidelines 30, the horizontal spacing between the inclined guidelines 40 is equal to the spacing between the vertical guidelines 30. Six equally spaced inclined guidelines 40 are provided, as well as a seventh and eighth guideline 44 and 46, with the spacing between the sixth inclined guideline and the seventh guideline 44, as well as the spacing between seventh guideline 44 and eighth guideline 46 being equal to one and one half the spacing between any of the first six inclined guidelines 40.

The guidelines 30, 40 may be formed as grooves in the plastic with their visibility being enhanced by inking the grooves with a colored ink. To facilitate readability, the color of the inks used to draw each guideline may be varied such that the user may readily distinguish each different guideline.

Figure 2:
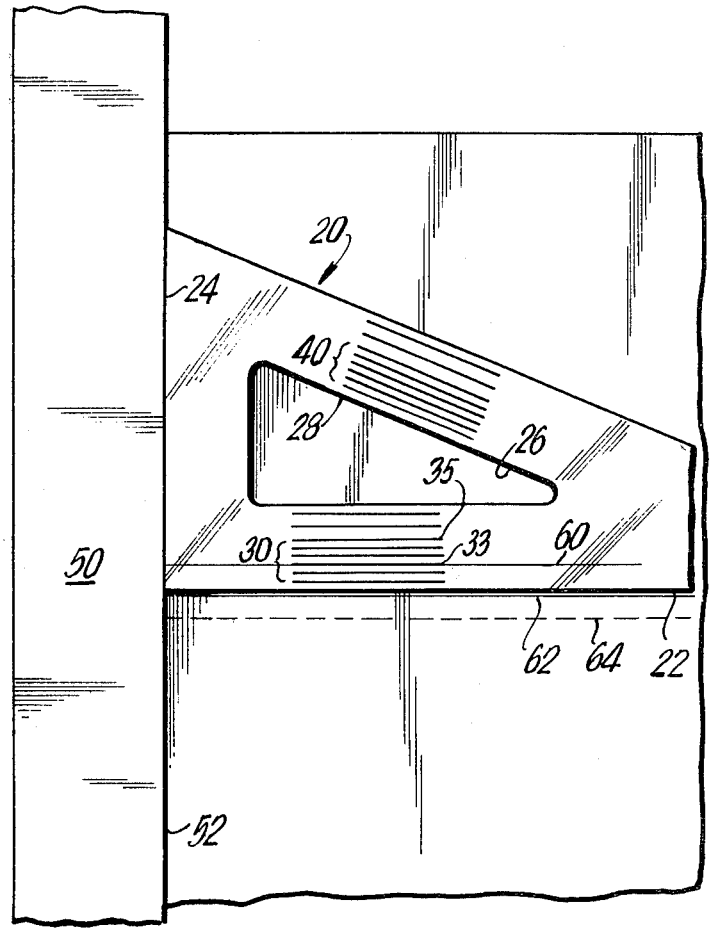
FIGS. 2 through 4 are elevational views of the lettering scale of the subject invention illustrating various steps in the use thereof.

When using the lettering scale 20 of the subject invention to accurately regulate the height and width of letters, it is first necessary to use the subject invention to draw a set of horizontal guidelines. For this purpose, the subject invention is used in conjunction with a straight edge guide 50 which may be a T-square or other device. As illustrated in FIG. 2, the lettering scale 20 is positioned such that the second straight edge 24, is in a vertical orientation and abuts the edge 52 of straight edge guide 50. A top horizontal guideline 60 may then be drawn using the first straight edge 22 of the triangle 20 as a guide.

A second, central horizontal guideline 62 may then be drawn. The central guideline 62, according to standard lettering practice, and using six units at the conventional height of the letter, should be spaced three units from both the top 62 and base horizontal guidelines. To accurately draw the central guideline 62, the lettering scale 20 is slidably moved downwardly, in a direction perpendicular to the first straight edge 22. The downward movement is guided by the straight edge guide 50 which is in abutting relationship to second straight edge 24 of the lettering scale 20. The lettering scale 20 is moved downwardly until the top horizontal guideline 60 is visibly in register with the third guideline 33, which corresponds to three units of space between the top horizontal guideline 60 and the first straight edge 22. As illustrated in FIG. 2, when the lettering triangle 20 is in a position such that the top horizontal guideline 60 is in register with the third visible guideline 33, the central guideline 62 may be drawn by inscribing a line along the first straight edge 22. In a similar manner, the base line 64 may be drawn by downwardly positioning the lettering triangle 20 until the third visible guideline 33 is in register with the central guideline 62. At this point, the sixth visible guideline 35 will also be in register with the top horizontal guideline 60, and the base line 64 can be drawn along first straight edge 22. The above described procedure results in the drawing of three equally spaced horizontal guidelines 60, 62 and 64, as illustrated in FIG. 5.

In the prior art, when it is desired to regulate the width and the spacing between letters, the draftsman would at this stage, either estimate the placement of the letters or draw vertical guidelines, to aid in the placement of the letters. In accordance with the subject invention, guide points can be drawn which correspond to the stroke lines of the letters, such that the necessity for drawing vertical guidelines is eliminated.

Figure 5:
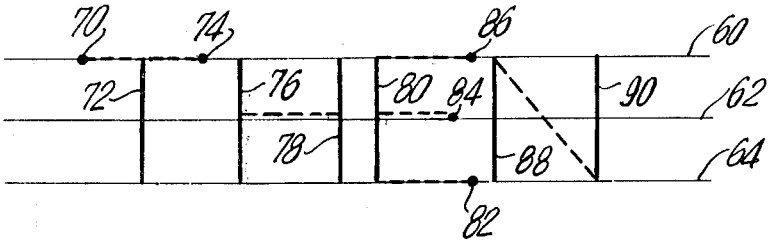
FIG. 5 illustrates the placement of the guide points and their connection to form letters which have their width and height regulated.
Figure 4:
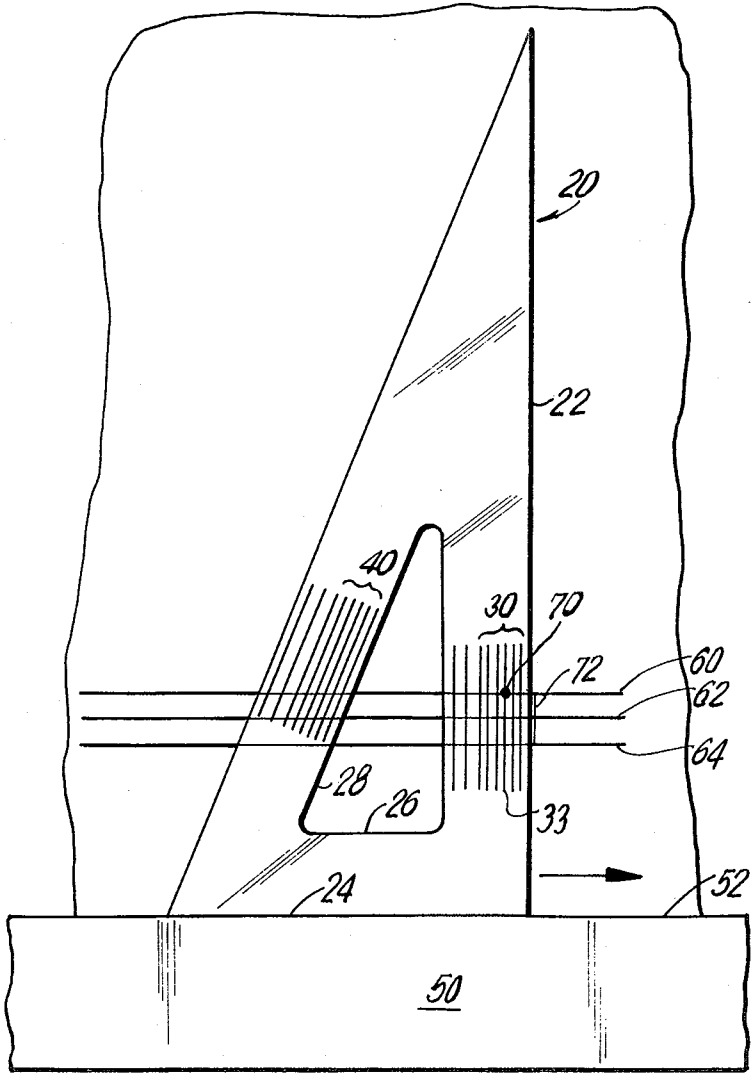
Figure 3:
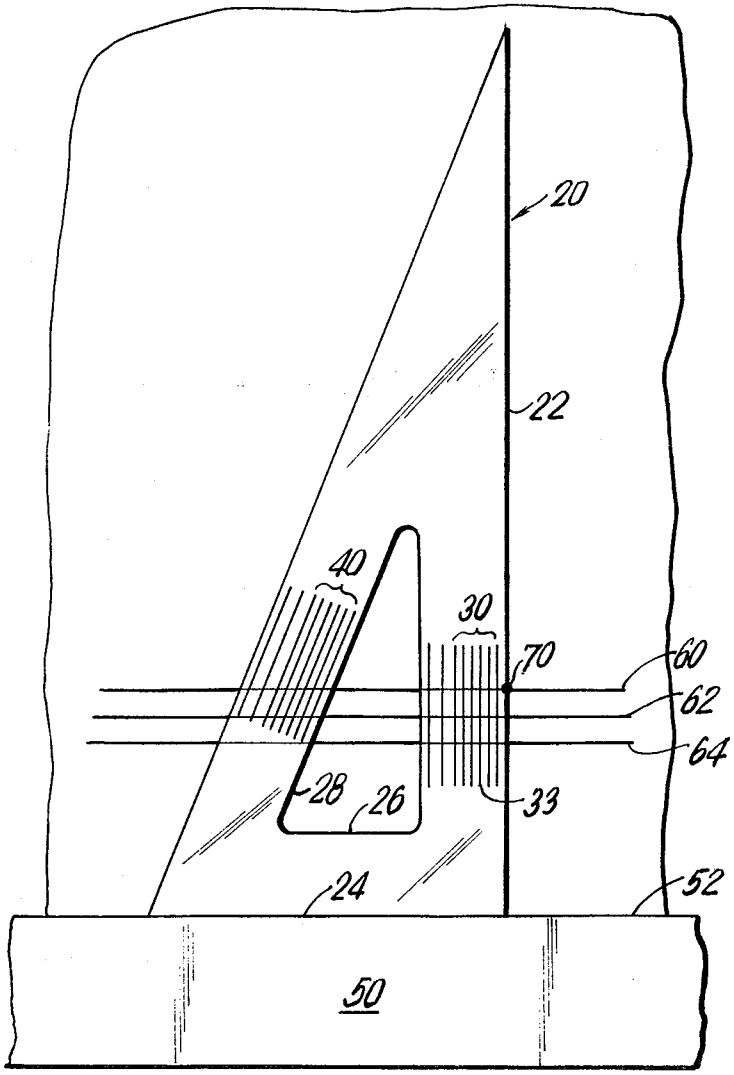

FIGS. 3–5 illustrate the use of the lettering scale 20 of the subject invention to letter the word THEN. As is illustrated in FIG. 3, the straight edge guide 50 is repositioned to be in parallel relationship to the horizontal guidelines and spaced therefrom a distance such that the visible guidelines 30 of the lettering scale 20 will intersect the horizontal guidelines. In use, a first guide point 70 is drawn adjacent the first straight edge 22. For purpose of clarity, the size of the guide points shown in the figures are exaggerated, but in practice the guide points should be drawn relatively lightly such that they will be covered by the strokes of the letters.

According to standard lettering practice, the top bar portion of the letter T is six units wide, relative to a six unit letter height. In addition, the center vertical stroke of the T is equally spaced from the end points of the top bar of the T. Thus, the center vertical stroke of the T must be spaced three units away from the start of the top bar of the T. To locate the vertical stroke 72 three units from the first guide point 70, the lettering scale 20 is shifted to the right in a direction perpendicular to the first straight edge 22 by slidably moving the second straight edge 24 along the top edge 52 of the straight edge guide 50. As illustrated in FIG. 4, the lettering scale 20 is shifted until the first guide point 70 is in register with the third visible guideline 33. By this arrangement, the first straight edge 22 is spaced three units away from the first guide point 70. A second guide point may then be drawn adjacent the first straight edge which will indicate to the draftsman where to place the center vertical stroke of the T. To reduce the time necessary to draw the letters, rather than placing a guide point adjacent the first straight edge, the vertical stroke 72 may be immediately drawn instead. As illustrated in FIG. 4, by using the first straight edge as a guide, the vertical stroke of the letter T may be drawn.

By continuing to follow the above described steps, all the vertical strokes, as well as the necessary guide points in the word THEN can be drawn. More specifically, guide point 74, as illustrated in FIG. 5, is drawn three units away from vertical stroke 72 by shifting the lettering scale 20 until vertical stroke 72 is in register with the third visible guideline 33. Guide point 74 may then be drawn, on top line 60, adjacent the first straight edge 22 of the lettering triangle 20. The spacing between the end of the letter T (corresponding to guide point 74) and the first vertical stroke of the letter H is one unit in length. Thus, the lettering scale 20 is shifted until guide point 74 is in register with first guideline 32. Vertical stroke 76 corresponding to the first vertical stroke of the letter H may then be drawn adjacent the first straight edge 22 of the lettering scale 20. The remaining guide points and vertical strokes are added in a similar manner. Briefly, vertical stroke 78, corresponding to the second vertical stroke of the letter H, is drawn five units away from vertical stroke 76, while vertical stroke 80, corresponding to the vertical stroke of the letter E is spaced two units away from vertical stroke 78. Guide points 82 and 86 representing the ends of the top and bottom horizontal strokes of the letter E are spaced five units away from vertical stroke 80.

In accordance with conventional lettering practice, the central horizontal stroke of the letter E is spaced four and one half units from its vertical stroke. To locate guidepoint 84, corresponding to the end of the central horizontal stroke, the lettering scale 20 is shifted until vertical line 80 is disposed between the fourth and fifth visible guidelines. Since the guidelines 30 are spaced relatively close together, the scale 20 may be adjusted to locate a guide point midway between two guidelines with a fairly high degree of accuracy. Guide point 84 may then be drawn on center line 62 adjacent first straight edge 22 which is four and one half units from vertical stroke 80. Thereafter, vertical stroke 88 corresponding to the first vertical stroke of the letter N is spaced one unit away from the guide points 82, 86 and vertical stroke 90 is spaced five units from the vertical stroke 88.

After the vertical strokes and the guide points 70 through 90 have been drawn, the draftsman merely has to complete the letters by connecting the points and strokes. Conveniently, any straight edge of the scale 20 may be used to draw the straight strokes connecting the guide points. For example, a horizontal stroke connects guide points 70, 74 of the letter T and an inclined stroke is drawn between the vertical strokes 88, 90 of the letter N. The remaining letters are similarly formed by connecting the guide points, as illustrated in FIG. 5. Curved strokes, such as in those in the letter B may be drawn freehand, using the guidelines to locate points on the curve.

The versatility of the lettering scale 20 is enhanced by additionally including the seventh and eighth guidelines 34, 36. Guidelines 34, 36 may be utilized when drawing a combination of large capital letters and small capital letters in a manner similar to the above described steps. Conventional large capital letters are one and one half times larger than standard small capital letters. By providing for an eighth guideline 36 which is spaced nine units from first straight edge 22, or one and one half times greater than the spacing between the sixth guideline and the first straight edge 22, the guide points for large capital letters may be conveniently drawn. More specifically, eighth guideline 36 can be used to locate the guide points corresponding to the height of the large capitals. In addition, both the seventh and eighth guidelines 34, 36 can be used to regulate the proportionally larger width of the large capital letters.

The seventh and eighth guidelines 34, 36 are provided to illustrate the versatility of the subject invention. The lettering scale of the subject invention may additionally be used to draw condensed or extended letters by varying the proportions of the letters in accordance with conventional lettering practice. Further, the actual number of guidelines provided on the lettering guide, as well as the spacing therebetween may be varied in accordance with the subject invention depending upon the type of lettering which is desired to be drawn. It is intended that the scope of the subject invention included any arrangement wherein a plurality of parallel visible guidelines are provided wherein the spacing from the first straight edge is accurately fixed. To faciliate the drawing of standard letters, it is desirable to provide at least six equally spaced guidelines, with the spacing between the first straight edge and the nearest guideline being equal to the spacing between each individual guideline.

Figure 6:
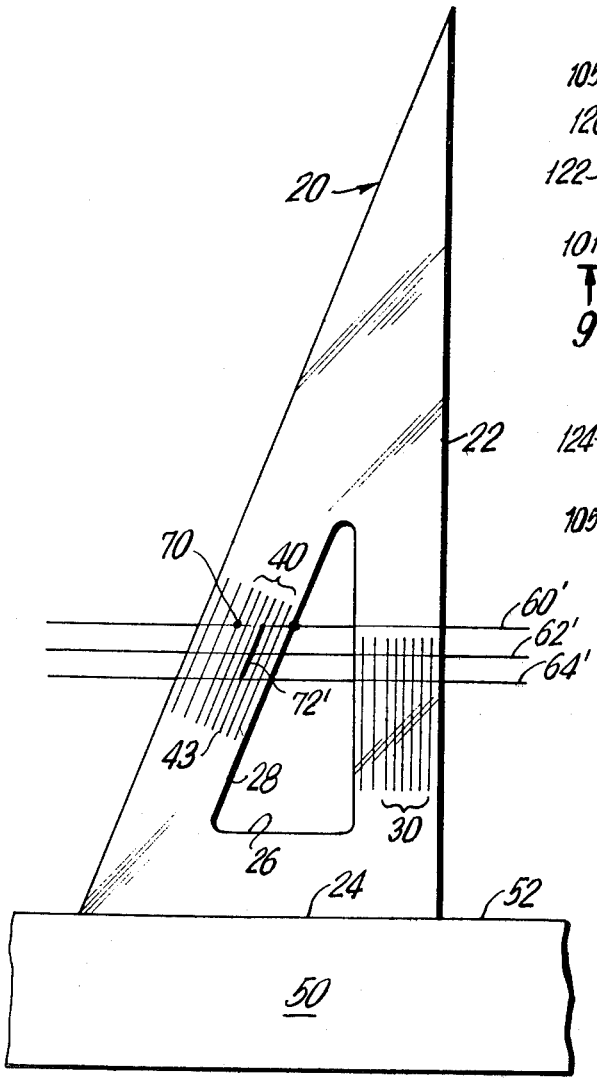
FIG. 6 is an elevational view of the lettering scale of the subject invention as used to inscribe guide points for inclined letters.
Figure 7:
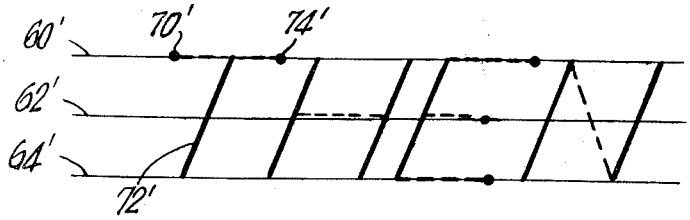
FIG. 7 illustrates the placement of guide points and their connection to form inclined letters.

The lettering scale 20 of the subject invention may be used to draw guide points for inclined letters similar to those illustrated in FIG. 7. When drawing inclined letters, horizontal guidelines 60', 62' and 64' for controlling the height of the letters, are initially drawn in a manner similar to that described above when drawing conventional vertical lettering. To regulate the width and spacing of inclined letters, the inclined visible guidelines 40 are used in conjunction with the third straight edge 28 of the lettering scale 20. Initially, and as illustrated in FIG. 6, lettering scale 20 is positioned such that second straight edge 24 is in abutting relationship with the top edge 52 of the straight edge guide 50. Thereafter, for example, when lettering the word THEN, first guide point 70' is drawin adjacent the third straight edge 28. A first inclined stroke 72', corresponding to the central stroke of the letter T may be drawn a fixed distance from first guide point 70' using the same method as described above. More specifically, the lettering scale 20 is shifted in a direction perpendicular to the first straight edge 22 until first guide point 70' is in register with the third inclined visible guideline 43. In this position, the third straight edge 28 is spaced three units from the first guide point 70'. Thus, the inclined stroke 72', when drawn adjacent the third straight edge 28, will be properly spaced from the first guide point 72'. In addition, since the third straight edge 28 is conveniently disposed at an angle of 68.2 degrees from the horizontal, the inclined stroke 72' may be readily and accurately drawn having the standard angle of inclination. Third guide point 74' corresponding to the end of the top bar of the letter T may be drawn on top horizontal guideline 60 by shifting the lettering scale 20 until inclined stroke 72' is in register with the third inclined visible guideline 43. In this manner, the remaining guide points and inclined strokes corresponding to the word THEN may be drawn and interconnected. The seventh and eighth guidelines 44 and 46 are provided, as discussed above, to increase the flexibility of the lettering scale when drawing a combination of large and small capital letters.

Figure 8:
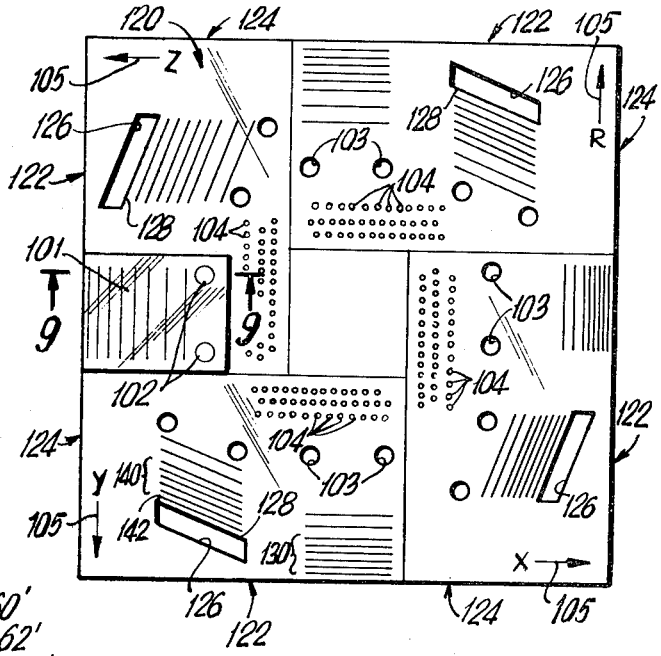
FIG. 8 is an elevational view of a second embodiment of the lettering scale of the subject invention.

It is apparent that the distance between the first straight edge 22 and the sixth guideline will determine the size of the letters which can be drawn. It is intended that the spacing between the first straight edge 22 and the sixth visible guideline correspond to a specific conventional lettering height such as a one quarter, or half inch lettering. However, to further increase the versatility of the lettering scale 20, a plurality of sets of guidelines may be provided each set having a different spacing between the guidelines with each set being used to draw letters of a different size. More specifically, and as illustrated in FIG. 8, a second embodiment of the subject invention includes four sets of straight and inclined guidelines to allow for drawing of four different size letters. Each quadrant (X, Y, Z and R) of the lettering scale 120 of the second embodiment of the subject invention includes a first straight edge portion 122 and a second straight edge portion 124 which corresponds to the first and second straight edges of the triangular lettering scale 20. In addition, each quadrant of the lettering scale 120 is provided with a plurality of visible guidelines 130 which are parallel to the first straight edge 122, and a second set of inclined guidelines 140 which are disposed at an angle of 68.2 degrees to the second straight edge 124. An open area 126 is provided in each quadrant, which defines a third straight edge 128 adjacent the first inclined guideline 142.

Figure 9:
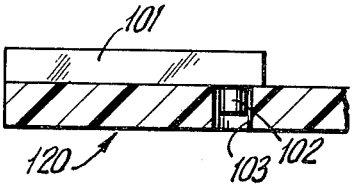
FIG. 9 is a cross sectional view of the lettering scale of the subject invention taken along line 9—9 of FIG. 8.

Since the visible guidelines 130, 140 in each set are spaced relatively close together, a magnityfing glass 101 may be provided to facilitate the viewing of the guidelines. Magnifying glass 101 is generally rectangular in configuration having dimensions sufficient to overlap the visible guidelines in each array. To minimize manufacturing costs, a single magnifying glass 101 is provided which can be positioned over the particular set of guidelines then in use. Magnifying glass 101 includes a pair of spaced pins 102 which are adapted to be received in a pair of spaced apertures 103 associated with each set of guidelines. As illustrated in FIG. 9, the pins 102 of the magnifying glass 101 are slidably received within apertures 103. By this arrangement, the position of the magnifying glass is maintained during the use of a particular set of visible guidelines.

As illustrated in FIG. 8, each quadrant additionally includes a set of guide holes 104 which correspond to the guide holes discussed in the previously cited U.S. Pat. No. 1,721,793 to Rowe. The array of holes 104 are provided to facilitate the drawing of horizontal guidelines, as fully described in the cited references, which are used to control the height of the letters. To control the width and spacing between the letters, the visible guidelines 130, 140 of a selected quadrant are used.

The spacings between the visible guidelines in each particular guadrant corresponds to a particular conventional letter size. As illustrated in FIG. 8, the letters X, Y, Z and R could represent, for example, letter sizes of 3/16, 5/16, ½ and ⅝ of an inch in height. In this example, the spacings between the first (or third) straight edges 122 (128) and the sixth visible guideline in the associated array will correspond to the letter heights of 3/16, 5/16, ½ and ⅝. The spacing between each individual guideline would therefore be equal to one sixth of the spacing between the first straight edge and the associated sixth visible guideline.

In use, the draftsman merely chooses the particular letter size intended to be drawn and employs the quadrant of the lettering scale 120 corresponding to that letter size. For example, when the draftsman chooses the quadrant represented by the letter X in FIG. 8, the letter X will indicate the proper orientation of the lettering scale 120 while the arrow 105 will indicate the direction of slidable movement of the scale 120 when drawing horizontal guidelines or guide points. More specifically, when using the guidelines 130 in quadrant X, the second straight edge 124 adjacent the letter X is placed in abutting relationship with a straight edge guide such that guidelines 130 in that quadrant may be used in a manner similar to the guidelines of the triangular lettering scale 20. Inclined letters may be drawn by using inclined guidelines 140 and third straight edge 128. If the draftsman desires to draw letters of a different size, the lettering scale 120 is merely inverted until the corresponding quadrant is in the desired position.

Figure 10:
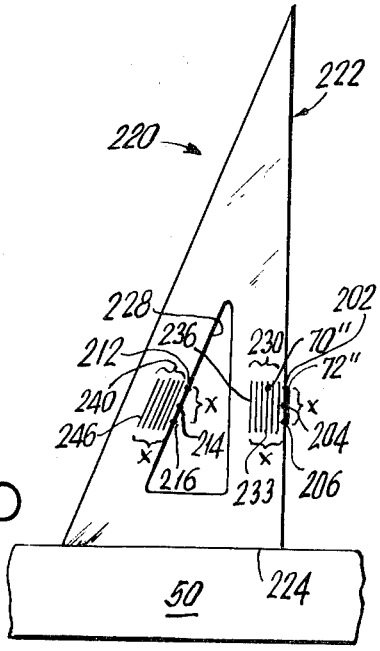
FIG. 10 is an elevational view of a third embodiment of the lettering scale of the subject invention.

In certain cases it is undesirable to intially draw horizontal guidelines for regulating the height of the letters. For example, if the letters themselves are to be drawn in pencil, erasure of the horizontal guidelines would be difficult. In order to eliminate the necessity of drawing horizontal guidelines, the subject invention may be provided with a set of guide markers, which are spaced apart a distance corresponding to the desired height of the letters. More particularly, and as illustrated in FIG. 10, the third embodiment of the subject lettering scale 220 is provided with a set of guide markers 202, 204, 206 disposed adjacent first straight edge 222. The spacing X, between the top and bottom guide markers 202,206 is equal to the distance X between first straight edge 222 and the sixth visible guideline 236 in the array of vertical guidelines 230. This spacing corresponds to conventional lettering wherein the height of each letter is equal to six units of spacing. Middle guide marker 204 is spaced equidistant from the top and bottom guide markers 202, 206.

A similar set of guide markers 212, 214, and 216 are provided adjacent third straight edge 228. The vertical spacing X between top and bottom guide markers 212, 216 is equal to the horizontal distance X between third straight edge 228 and sixth visible guideline 246 in the array of inclined guidelines 240. Middle guide marker 214 is disposed equidistant from the top and bottom guide markers 212, 216. In the illustrated embodiment, the spacing X between the top and bottom guide markers 202, 206 is equal to the vertical spacing between the top and bottom guide markers 212, 216. Further, to enable the user to draw a combination of vertical and inclined letters, the respective spacing between the second straight edge 224 and the top 202, 212, middle 204, 214 and bottom 206, 216 guide markers is equal.

In use, the guide markers function to define the height of the letters. To insure the proper placement of the letters on the page, the straight edge guide 50 must be maintained in a fixed position throughout the drawing of each line of letters. In contrast, when using the lettering scale 220 in conjuction with horizontal guidelines the straight edge guide 50 must merely be disposed parallel to the horizontal guidelines, and positioned such that the visible vertical guidelines 230 overlap the horizontal guidelines.

To use the lettering scale 220 without first drawing horizontal guidelines, the straight edge guide 50 must be accurately positioned such that the guide markers are disposed at the desired location on the page. Thereafter, the guide points and strokes of the letters may be drawn on the page using the guide markers to regulate height of the letters, and the vertical guidelines to regulate their width and spacing. More particularly, and for example when lettering the word THEN, a first guide point 70″ corresponding to the start of the top bar of the letter T is drawn adjacent the first straight edge 222, and adjacent the top guide marker 202. Thereafter, the lettering scale 220 is shifted in a direction perpendicular to first straight edge 222 along second straight edge 224 which abuts straight edge guide 50. The lettering scale 220 is shifted until guide point 70″ is in register with third visible guideline 233. Vertical stroke 72″ is then drawn, as illustrated in FIG. 10, adjacent first straight edge 222, extending between top and bottom guide markers 202, 206.

The remaining guide points and strokes are added in a similar manner. However, since there are no horizontal guidelines, some additional guide points corresponding to non-vertical strokes must be drawn adjacent the corresponding guide marker, to allow for the accurate drawing of letters. For example, when using horizontal guidelines the central horizontal guide line is used to locate the center bar of the letter H when connecting the two vertical strokes. When horizontal guidelines are not used, guide points are drawn on the vertical strokes of the letter H, adjacent the middle guide marker 204, to indicate the location of the horizontal bar. While the use of the guide markers necessitate the drawing of a few additional guide points, their use provides a viable alternative when the drawing of horizontal guidelines is undesirable or inconvenient. The drawing of inclined letters is accomplished in a similar manner using the inclined guide lines 240 and guide markers 212, 214 and 216.

Accordingly, there is provided a new and improved lettering scale for regulating the height and width of letters, as well as the spacing therebetween. More particularly, a lettering scale has been provided which allows for the drawing of guide points which aids in maintaining the uniformity of the letters. The lettering guide is formed from a transparent, plastic member having at least first and second straight edges which are disposed in perpendicular relationship. In addition, a plurality of spaced, parallel, visible guidelines are provided which are disposed in parallel relationship to the first straight edge, with the spacing from the first straight edge being fixed. In a preferred embodiment, at least six equally spaced guidelines are provided with the spacing between the first straight edge and the nearest visible guideline being equal to the spacing between the individual guidelines. By this arrangement, in operation, after the drawing of a first guide point, the planar member is shifted in a direction perpendicular to the first straight edge by slidably moving the second straight edge along a straight edge guide until one of the visible guidelines is in register with the first guide point. Thereafter, a second guide point may be drawn adjacent the first straight edge, such that the second guide point is accurately spaced from the first guide point. In another embodiment of the subject invention, guide markers are provided adjacent to first staight edge and can be used as guides to eliminate the necessity of drawing horizontal guidelines.

Although the subject invention has been described by reference to preferred embodiments, it is apparent that other modifications could be devised by those skilled in the art that would fall within the scope and spirit of the present invention as defined by the appended claims.

What is claimed is:

1. A lettering scale for regulating the width of letters and the spacing therebetween, to be used in combination with a straight edge guide, said lettering scale comprising:

a generally planar transparent member having first and second straight edges disposed in perpendicular relationship, and including an open interior area defining a third straight edge, said third straight edge being disposed at an angle relative to said second straight edge;

a plurality of equally spaced, vertical guidelines formed in an array on said member and disposed in parallel relationship to said first straight edge, with the spacing between said first straight edge and the nearest vertical guideline of said array being equal to the spacing between each said vertical guideline of said array; and a plurality of equally spaced, inclined guidelines formed in an array on said member and disposed in parallel relationship to said third straight edge, with the spacing between said third straight edge and the nearest visible inclined guideline of said array being equal to the spacing between each said inclined guideline of said array, and wherein the spacing between each said vertical guideline is equal to the spacing between each said inclined guideline measured along a line parallel to said second straight edge.

2. A lettering scale as recited in claim 1 wherein the included angle between said second and third straight edges is equal to 68.2°.

3. A lettering scale as recited in claim 1 wherein said planar transparent member is generally triangular in configuration.

4. A lettering scale as recited in claim 1 having six vertical guidelines and six inclined guidelines.

5. A lettering scale as recited in claim 4 further including seventh and eighth vertical guidelines, with the spacing between the sixth vertical guideline and the seventh vertical guideline, and the spacing between the seventh vertical guideline and the eight vertical guideline, being equal to one and one half times the spacing between each of the first six vertical guidelines, said lettering scale further including seventh and eighth inclined guidelines, with the spacing between the sixth inclined guideline and the seventh inclined guideline and the spacing between the seventh inclined guideline and the eighth inclined guideline being equal to one and one half times the spacing between each of the first six inclined guidelines.

6. A lettering scale as rectied in claim 4 further including first top and bottom guide markers disposed adjacent said first straight edge, with the spacing between said first top and bottom guide markers being equal to the distance between said first straight edge and the sixth vertical guideline, said scale further including a first middle guide marker disposed adjacent said first straight edge and spaced equidistant from said first top and bottom guide markers.

7. A lettering scale as recited in claim 6 further including second top, middle and bottom guide markers disposed adjacent said third straight edge, said second guide markers being repsectively spaced from said second straight edge an amount equal to the spacing between the second straight edge and the respective first top, middle and bottom guide markers.

8. A lettering scale for regulating the width of letters and the spacing therebetween to be used in combination with a straight edge guide, said lettering scale comprising:

a generally square, planar transparent member, said square having four quadrants, with each quadrant of said square including first and second straight edges which are in perpendicular relationship, with each said quadrant being provided with a plurality of vertical guidelines formed thereon in an equally spaced array and disposed in parallel relationship with the associated first straight edge, with the spacing between each first straight edge and the nearest vertical guideline of the associated array being equal to the spacing between each said vertical guideline in said array and with the spacing between said vertical guidelines in each said quadrant being different, thereby allowing for the regulation of width and spacing of letters of different sizes, and with each said quadrant further including an open interior area defining a third straight edge, said third straight edge being disposed at an angle relative to the associated second straight edge, and with each said quadrant further including a plurality of inclined guidelines formed thereon in an equally spaced array and disposed in parallel relationship to the associated third straight edge, with the spacing between each third stright edge and the nearest inclined guideline of the associated array being equal to the spacing between each said inclined guideline in said associated array, and with the spacing between the vertical guidelines in each quadrant being equal to the spacing between the inclined guidelines of the associated quadrant, measured along a line parallel to said second straight edge.

* * * * *